US006286351B1

(12) United States Patent
Schulze

(10) Patent No.: US 6,286,351 B1
(45) Date of Patent: Sep. 11, 2001

(54) TOOL ENGRAVING OF A DEFORMATION TOOL FOR DEFORMING WITH AN ACTIVE MEDIUM

(75) Inventor: Bernd Schulze, Wohnsitz (DE)

(73) Assignee: Dr. Meleghy Hydroforming GmbH & COKG, Zwickau (DE)

( * ) Notice: Subject to any disclaimer, the term of this patent is extended or adjusted under 35 U.S.C. 154(b) by 0 days.

(21) Appl. No.: 09/360,516

(22) Filed: Jul. 26, 1999

(30) Foreign Application Priority Data

Jul. 24, 1998 (DE) ..... 198 33 550

(51) Int. Cl.[7] ..... B21D 22/10
(52) U.S. Cl. ..... 72/60; 72/61
(58) Field of Search ..... 72/58, 60, 61, 72/53

(56) References Cited

U.S. PATENT DOCUMENTS

| | | | | |
|---|---|---|---|---|
| 4,581,913 | * | 4/1986 | Reed | 72/53 |
| 5,592,840 | * | 1/1997 | Miyasaka | 72/53 |
| 5,647,239 | * | 7/1997 | Fischer | 72/60 |
| 5,649,438 | * | 7/1997 | Hall, Jr. et al. | 72/60 |
| 5,671,628 | * | 9/1997 | Halila et al. | 72/53 |
| 6,016,603 | * | 1/2000 | Marando et al. | 72/61 |
| 6,041,633 | * | 3/2000 | Bieling . | |

FOREIGN PATENT DOCUMENTS

| | | | |
|---|---|---|---|
| 44 34 799 A1 | * | 9/1994 | (DE) . |
| 44 36 437 A1 | * | 10/1994 | (DE) . |
| 195 35 870 A | * | 9/1995 | (DE) . |
| 29617276 | | 3/1998 | (DE) . |
| 4-294831 | * | 10/1992 | (JP) . |

* cited by examiner

*Primary Examiner*—David B. Jones
(74) *Attorney, Agent, or Firm*—Horst M. Kasper

(57) ABSTRACT

The invention concerns an engraved surface of a deformation tool which deforms a workpiece with an active medium, wherein the deformation tool has a pressure agent feed for the active medium and an engraved surface according to the desired final contour of the workpiece. Accordingly deformation methods are performed with hydro-deforming as well as of internal high-pressure metal forming of a wall of a workpiece by the engraved surface of the tool by way of the pressure medium. Upon withdrawal of the workpiece the pressure medium can pass to the engraved surface of the tool, during the deformation of the following workpiece no contact between the engraved surface and the workpiece wall occurs due to the pressure agent adhering to the engraved surface, whereby undesired deformations occur on the workpiece. Accordingly to overcome this problem microstructures are provided on the engraved surface, wherein the microstructures are suitable to receive the active medium adhering to in the wall of the workpiece and the engraved surface. Undesired deformations of the workpiece are thereby avoided. Furthermore the engravings can serve as a depot for lubricant and thus to minimize friction.

13 Claims, 2 Drawing Sheets

TOOL ENGRAVING OF A DEFORMATION TOOL FOR DEFORMING WITH AN ACTIVE MEDIUM

BACKGROUND OF THE INVENTION

1. Field of the Invention

The present invention relates to a tool engraving of a deformation tool for deforming with an active medium, wherein the tool exhibits a pressure medium feed line for the active medium and an engraving corresponding to the final contour of the work piece and wherein liquid or gaseous pressure agents are employed as an effective medium.

2. Brief Description of the Background of the Invention Including Prior Art

The deformation of the wall of the work piece relative to the engraving of the tool is performed by the pressure of the pressure medium in connection with the generic deformation methods in case of hydrodeforming (compare for example German printed patent document DE 4434799 A1) as well as in case of internal high-pressure deforming (compare for example German printed patent document DE 19535870 A1 and A. Notrott: Neuere Entwicklungen in der Blechumformung; K. Siegert: Neuere Entwicklungen beim Innenhochdruckumformen . . . , 1998, Publisher MAT-INFO Werkstoffinformationsgesellschaft mbH, S. 365–367). During removal of the work piece, the pressure medium can pass to the engraving of the tool, whereby no contact between engraving and wall of the work piece occurs during metal forming of the following workpieces in that region, where the pressure agent adheres to the engraving, whereby undesired deformations occur at the tool piece. These deformations cause limitations in the evaluation of the surface quality of the work piece. Bubble formations between sheet metal or thin foils to be deformed and the engraving can occur also in connection with gaseous active media, whereby again undesirable deformations of the workpieces are generated.

SUMMARY OF THE INVENTION

1. Purposes of the Invention

It is an object of the present invention to prevent deformations of the work piece by the active medium as well as to improve the surface quality and simultaneously to obtain defined surface properties of the work piece.

It is another object of the present invention to furnish microengraved work pieces.

It is yet a further object of the present invention to furnish an engraving tool capable of impressing microstructures.

These and other objects and advantages of the present invention will become evident from the description which follows.

2. Brief Description of the Invention

According to the present invention microstructures are incorporated in the engraving of the tool. These microstructures should not negatively influence to the surface quality of the tool and should be suitable to receive the pressure medium adhering in the engraving during the pressing on of the work piece and to oppose at deformation by a local damming or congestion of the pressure medium between engraving and work piece. Furthermore there exists the possibility to purposefully influence the surface structure of the workpiece by the microstructures, such that for example of more uniform metal forming occurs and better adhering properties are assured for a next following coating.

The microstructures should have a dimension in the order of magnitude of the size of a molecule of the pressure medium up to 100 micrometers breadth and 100 micrometers depth or height. The microstructures can have desired arbitrary forms and can be disposed at the same or different distances relative to each other or they can join into each other and for example form line structures, meander like structures or punctual shaped structures. The microstructures can be disposed over the whole face of the engraving of only be disposed at certain defined positions (for example in radial elements), if only at the locations there exists the danger of a deformation, or if only at certain surface regions of the work piece particular surface properties are desired (for example adhering properties and friction properties).

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
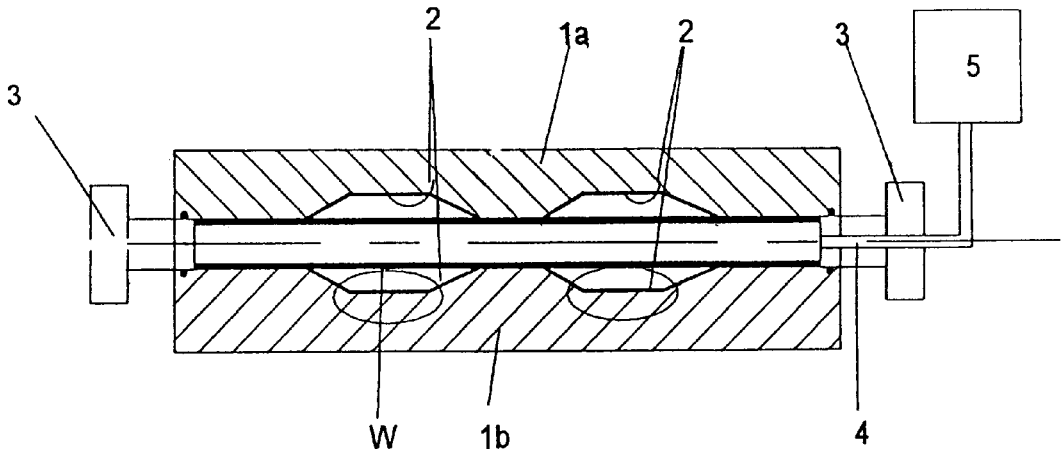
FIG. 1 is a schematic sectional view of an internal high-pressure deforming tool.

FIG. 1 shows an internal high-pressure and metal forming tool with an upper tool half 1*a* and a lower tool half 1*b*, wherein the upper tool half 1*a* and the lower tool half 1*b* are movable relative to each other for placing and removal of the work piece. The two tool halves 1*a*, 1*b* are closed in the illustrated example and exhibit an engraving or engraved surface 2. The not yet deformed tubular work piece W is disposed in the internal high-pressure deforming tool. Pusher cylinders 3 engage at the two tubular ends of the workpiece, wherein the pusher cylinders assure the successive flow of the work material during the internal high-pressure metal forming and simultaneously seal the work piece W. A pressure agent feed line 4 leads to the pusher cylinder 3 illustrated on the left side in FIG. 1, and the pressure medium is fed to the work piece for example by way of a hydraulic aggregate. The wall of the work piece then is laid at the inner contour of the tool during an inner high-pressure deforming based on the pressure of the pressure medium and thus to the engraving 2 of the internal high-pressure deformation tool. The engraving is either completely covered with microstructures or only in those regions, where the liquid pressure medium can collect (separately marked) prior to the insertion of the next work piece. Depending on the materials involved, the applied pressure and temperature have to be sufficient to effect the desired deformation of the work piece.

The internal high-pressure and metal forming tool of FIG. 1 operates as follows. The upper tool half 1*a* and The lower tool half 1*b* is placed in position. Then the work piece is placed onto the lower tool half. Then the upper tool half 1*a* is placed on top of the lower tool half 1*b* and on top of the work piece. The two tool halves 1*a*, 1*b* are thereby closed as illustrated in FIG. 1. An engraving 2 is located on the inner face of the first tool half and on the inner face of the second tool half. The not yet deformed tubular work piece W is disposed in the internal high-pressure deforming tool and connected to the pusher cylinders 3, which engage at the two tubular ends of the workpiece. The pusher cylinders surround the pressure feed line and seal the work piece against the inner surface of the work pieces. A pressure agent feed line 4 leads to the pusher cylinder 3 illustrated on the left side in FIG. 1, and the pressure medium is fed to the inside of the work piece from a hydraulic aggregate or supply 5 through the pressure agent feed line 4. The wall of the work piece then is pressed into the inner contour of the upper tool half and that of the lower tool half by a high-pressure deformation of the work piece based on the pressure of the pressure medium. The pressure generated inside the work piece is sufficient to transfer the engraving 2 on the inner surface of the upper tool half and of the lower tool half to the outside surface of the wall of the work piece. The microstructures present on the surfaces of the upper tool half and of the lower tool half are therewith also transferred and impressed and engraved onto the outer surface of the work piece. After the workpiece is furnished with the engraved microstructure, then the pressure and the work piece are released and thereupon the next work piece is processed in the same fashion so as to be furnished with microstructures on the outer surface.

The tool can also exhibit a subdivided form (compare FIG. 2) in connection with the deforming of single plates or double plates by way of an active medium. The upper tool half 1*a* for example is furnished here with the engraving 2 and the lower tool half 1*b* is furnished with a pressure space 6, wherein the pressure agent feed line joins into the pressure space 6. The tool piece W is tensioned in the form of a single plate between the closed tool halves 1*a* and 1*b*. The sheet metal (tool piece W) is formed against the engraving of the upper tool half 1*a* by way of the following pressure of the active medium in the pressure space and the application of further pressure. Again in this case the engraving can be furnished with microstructures, wherein the microstructures avoid either an undesired deformation of the work piece based on active medium trapped between the engraving and the tool piece and/or purposefully influence the surface quality of the work piece.

Figure 2:
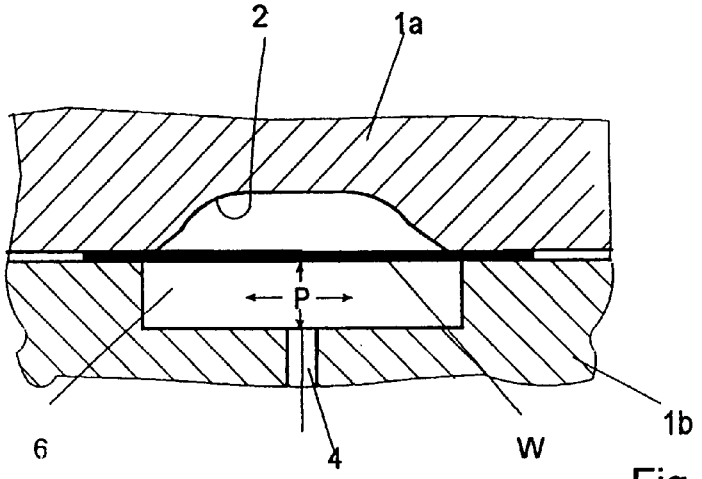
FIG. 2 is a schematic sectional view of a hydro deforming tool.
Figure 3:
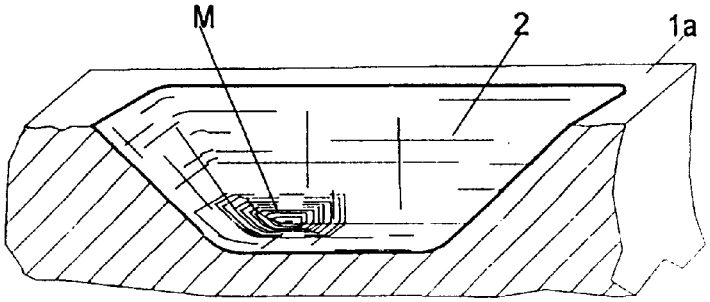
FIG. 3 is a perspective and in part sectional view of an engraving with microstructures in the corner regions.

A work piece with an engraving 2 according to FIG. 2 is illustrated in FIG. 3, wherein the microstructures M are disposed in the corner regions of the work piece.

Figure 4:
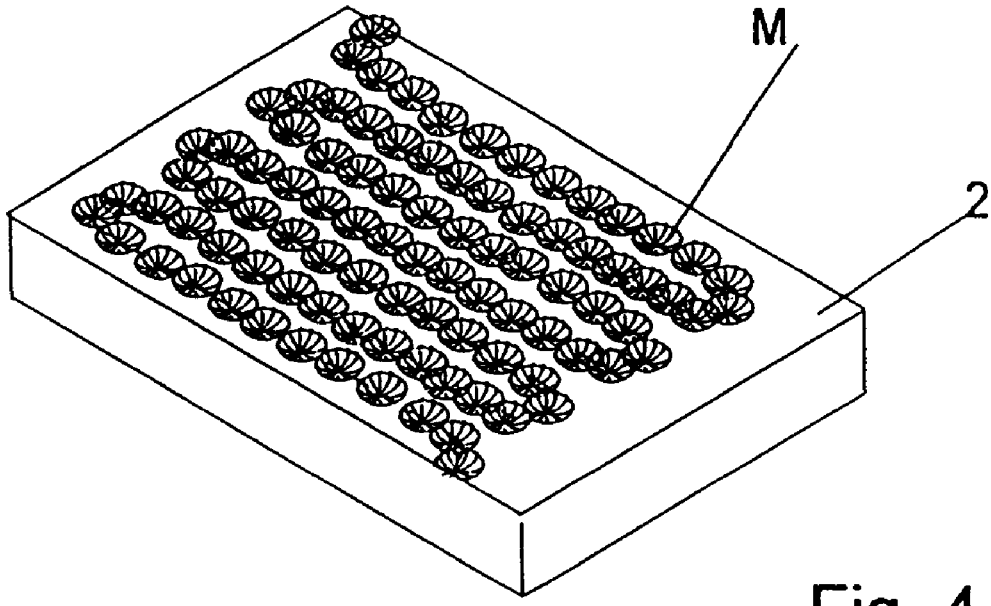
FIG. 4 is a perspective view with a meander shaped course of the microstructures.

A further embodiment of the line course of the microstructures M is illustrated in FIG. 4. The surface of the engraving 2 exhibits here smallest recesses in the form of microstructures M, wherein the dammed active medium can escape during deformations, such that a flawless surface of the workpiece W is assured. The microstructures are here arranged sequentially and of random shape.

Figure 5:
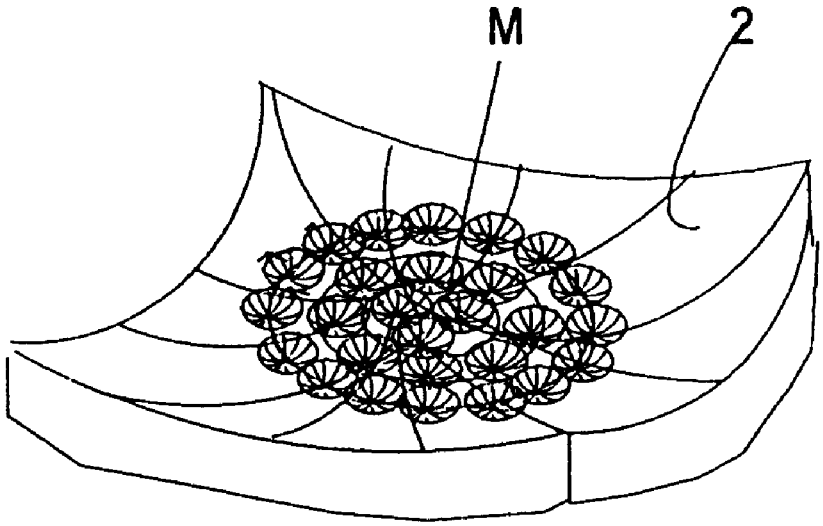
FIG. 5 is a perspective view with a circular line course of the microstructures.

A circular arrangement of the microstructures M is illustrated in FIG. 5, wherein the microstructures M can be disposed at the lowest point of the engraving 2.

The production of the microstructures M can be performed for example by laser processing, electro-erosive treatment, ultrasound erosion, scratching, etching, or other suitable dismounting methods or cutting methods. Particles can be applied on the engraving (for example by lithography) in an equivalent form, wherein the microstructures are generated by the particles applied. The shape, the size and the distance of the microstructures can be selected as desired or required.

The sequential arrangement of the microstructures can be of cross shape, of line shape, circular, meander shaped, or in other structures or forms.

Two embodiments with a random shaped and circular shaped line course of the microstructures M are illustrated in FIGS. 4 and 5.

A formation of bubbles by the microstructures is avoided in case of a deforming for example of thin foils with air, since the effective medium can escape into the microstructures.

For the first time it is further possible to form a lubricant depot in areas of high wear with the microstructures and to reduce decisively the wear in this manner.

This lubricant depot is for example filled in case of a very much lubricated workpieces and in case of too little lubricated parts the lubricant is released again based on the effective pressure during the pressing on of the component wall. The running properties in case of urgency for the tool or work piece are thus decisively improved in a surprising way. Furthermore a saving of lubricant at the workpiece can be achieved.

A defined influencing of the material flow is possible for example by a roughening of the engraving with the microstructures.

A surface of the work piece with a more favorable adhering properties can be generated by the microstructures for a successive coating of the work piece.

The size of the microstructures should advantageously be between 10 and 100 micrometers, in order to not allow the microstructures invisible at the surface of the work piece.

The invention can be employed in connection with internal high-pressure deforming of tubular workpieces as well as double plates resting at the edges against each other or possibly connected to each other as well as in connection with hydro deforming of single plates or double plates or in connection with hydromechanical deep drawing.

It will be understood that each of the elements described above, or two or more together, may also find a useful application in other types of engraving system configurations and work piece processing procedures differing from the types described above.

While the invention has been illustrated and described as embodied in the context of a tool engraving of a deformation tool for deforming with an active medium, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A deformation tool having an engraved surface comprising a pressure source containing an active medium;

a pressure agent feed line connected to the pressure source for transporting the active medium having a pressure;

an enclosed chamber connected to the pressure agent feed line and for accommodating a workpiece such that upon application of the active medium the workpiece is pressed against an inner surface of the enclosed chamber;

an engraved surface forming part of the inner surface and exhibiting a desired final surface structure to be placed on the workpiece, wherein the engraved surface is furnished with microstructures for deforming the workpiece according to the engraved surface when the workpiece is subjected to the active medium.

2. The engraving tool according to claim 1 wherein the microstructures do not degrade the surface quality of the work piece;

wherein the microstructures are adapted to be subjected to a driving force of the active medium in connection with internal high-pressure deforming during deforming of the workpiece by the engraved surface by a pressing on of the engraved surface onto the workpiece; wherein the microstructures are adapted to oppose a deformation based on a local damming of the active medium between the engraved surface and the workpiece; and wherein the microstructures are adapted to purposely influence the adhering properties of the workpiece.

3. The engraving tool according to claim 1 wherein the microstructures are for receiving lubricants and for serving as a depot for lubricants; and wherein the microstructures are for influencing the material flow of the workpiece during deformation.

4. The engraving tool according to claim 1 wherein the microstructures exhibit a defined size, shape and arrangement.

5. The engraving tool according to claim 1 wherein the microstructures exhibit a dimension in the order of magnitude of a molecule of the active medium up to about 100 micrometers width and 100 micrometers depth or 100 micrometers height.

6. The engraving tool according to claim 1 wherein the microstructures are disposed over the engraved surface and at defined positions.

7. The engraving tool according to claim 6 wherein the microstructures are located in regions of engraved surfaces selected from a member of the group consisting of regions, wherein the active medium is dammed in the engraving regions, regions, where deformations of the workpiece can occur, engraving regions intended to influence the surface structure of the workpiece, engraving regions subjected to a high wear, engraving regions to influence the flow of the material, and combinations of such regions.

8. The engraving tool according to claim 1 wherein the microstructures include a line shaped form.

9. The engraving tool according to claim 1 wherein the engraved surface is furnished with microstructures generated by laser processing, electro-erosive working, ultrasound erosion, scratching, etching, and other removal operations.

10. The engraving tool according to claim 1 wherein microstructures generated by lithography or by cutting methods are present.

11. The engraving tool according to claim 1 wherein the microstructures include a circular form.

12. The engraving tool according to claim 1 wherein the microstructures include a wave shaped form.

13. The engraving tool according to claim 1 wherein the microstructures include a sequentially disposed form.

* * * * *